US006240792B1

(12) United States Patent
Elsesser

(10) Patent No.: US 6,240,792 B1
(45) Date of Patent: Jun. 5, 2001

(54) SUPPORT AND TESTING APPARATUS FOR SNOW PLOW ASSEMBLY

(76) Inventor: David R. Elsesser, 326 Jackson, Petoskey, MI (US) 49770

( * ) Notice: Subject to any disclaimer, the term of this patent is extended or adjusted under 35 U.S.C. 154(b) by 0 days.

(21) Appl. No.: 09/317,599

(22) Filed: May 24, 1999

(51) Int. Cl.[7] ..... E01H 5/04
(52) U.S. Cl. ..... 73/865.9; 73/118.1; 37/234
(58) Field of Search ..... 37/231, 234, 235, 37/236; 73/118.1, 865.9

(56) References Cited

U.S. PATENT DOCUMENTS

| | | | | |
|---|---|---|---|---|
| 4,126,038 | | 11/1978 | Barlett et al. | 73/118 |
| 4,181,016 | | 1/1980 | Schapink | 73/168 |
| 4,211,110 | | 7/1980 | Glomski | 73/168 |
| 4,368,638 | | 1/1983 | Groves et al. | 73/168 |
| 4,821,435 | * | 4/1989 | Pester | 37/231 |
| 4,999,935 | | 3/1991 | Simi et al. | 37/236 |
| 5,103,671 | | 4/1992 | Dyvig | 73/168 |
| 5,195,261 | * | 3/1993 | Vachon | 37/236 |
| 5,353,530 | * | 10/1994 | Pieper | 37/231 |
| 5,694,808 | | 12/1997 | Weis | 73/168 |
| 5,832,637 | * | 11/1998 | Aguado et al. | 37/234 |
| 5,894,688 | * | 4/1999 | Struck et al. | 37/236 |

* cited by examiner

*Primary Examiner*—Eric S. McCall
(74) *Attorney, Agent, or Firm*—Douglas S. Bishop

(57) ABSTRACT

A support and testing apparatus is designed for use with a vehicle mountable snow plow assembly. Typical snow plow assemblies include a snow plow frame designed to attach to a vehicle, at least one hydraulic actuator for positioning the blade, and a lighting system with some type of interconnection device. The support and testing apparatus includes a frame designed to support a snow plow assembly. The frame includes a coupler for mechanically engaging the snow plow frame so that the snow plow assembly is supported on and retained by the frame. The support and testing apparatus also includes multiple wheels which are attached to the frame. At least one of these wheels is a caster which is pivotally mounted to the frame so that the wheel can pivot 360 degrees relative to the frame. The support and testing apparatus also includes an actuator system which is capable of actuating the hydraulic actuator on the snow plow assembly. An electrical lighting supply is supported on the frame and includes a coupler for engaging the interconnection device of the lighting system of the plow assembly. The lighting supply is operable to selectively supply power to the lighting system. A control panel is provided which has multiple switches for operating the actuator system and the electrical lighting supply.

11 Claims, 3 Drawing Sheets

SUPPORT AND TESTING APPARATUS FOR SNOW PLOW ASSEMBLY

FIELD OF THE INVENTION

The present invention relates generally to accessories for snow plow assemblies and, more specifically, to a support and testing apparatus for vehicle mountable snow plow assemblies.

BACKGROUND OF THE INVENTION

Vehicle mounted snow plows are very useful and popular for moving snow from roadways and parking lots. These snow plows typically include a snow plow blade that is interconnected with the frame of the vehicle using some type of snow plow frame. Typically, the snow plow blade may be pivoted side to side and lifted and lowered relative to the vehicle to facilitate the manipulation of snow.

Snow plow assemblies are somewhat complex and may include one or more hydraulic actuators and a variety of lights. Obviously, snow plow assemblies are susceptible to wear, damage and malfunction, making periodic repairs necessary. This is especially true in light of the harsh conditions under which snow plow assemblies are often operated. Snow plow assemblies are subjected to high levels of force and stress while being operated in harsh weather. Snow plow assemblies often are also exposed to contaminants such as grit, dirt, and salt, all of which may accelerate wear.

Traditionally, a snow plow assembly owner will drop the plow blade, plow frame, and accompanying operation hardware off at a repair facility when maintenance or repair is required. This presents several problems for the repair facility. The snow plow blade and accompanying support and operation hardware are heavy and awkward making it difficult to maneuver and manipulate the system. It is often necessary for these repair facilities to move the blade and support structure from one part of the facility to another. It is also often necessary or desirable to test the system after the repair and prior to returning it to the customer. Typically, repair facilities have one or more of their own plow vehicles to which they may attach the customer's system for testing. However, this ties up the facility's plow vehicle, preventing its use for other tasks. Also, there is more than one configuration of plow assembly, often making it difficult to use a given system with a given plow vehicle without substantial reconfiguration. Use of the facility's plow vehicle is also time consuming and wasteful of space. Since most repairs are done in the cold winter months, most facilities work on the plow assembly inside of a heated building. To use the facility's plow vehicle to test the customer's system, the vehicle must be pulled inside of the heated enclosure or, less desirably, the testing may be done outside.

In light of the above problems, there is a need for an apparatus that can support and operate a variety of snow plow assemblies for testing and assist in relocation of the snow plow assemblies. Most preferably, such an apparatus is relatively small, maneuverable and easy to operate and configure for a variety of assemblies. Most preferably, such an apparatus would be capable of manipulating a snow plow assembly, remote from a vehicle, in a manner mimicking the way the assembly would be operated on the vehicle during actual use. Also preferably, such an apparatus would be self contained, including its own power source, so that it is wholly capable of operating a plow assembly when removed from a vehicle.

There have been attempts to provide apparatus for the maneuvering and testing of snow plow assemblies. For example, a variety of support dollies are available that allow a plow assembly, remote from a vehicle, to be more easily moved from place to place. However, these systems do not provide for manipulation of the plow assembly as if it was being operated on a vehicle. There are also devices available for testing various aspects of the hydraulic system on a snow plow assembly. However, these devices are limited in their capabilities. Devices are also available for testing various aspects of electrical systems. For example, multi-meters allow testing for continuity and voltage within a system. Once again, these devices are insufficient to allow adequate testing of a snow plow assembly removed from a vehicle.

SUMMARY OF THE INVENTION

The present invention overcomes many of the shortcomings of the prior art by providing a support and testing apparatus for a vehicle mountable snow plow assembly. The apparatus is designed for use with snow plow assemblies of the type having a snow plow frame configured for attachment to a vehicle, a hydraulic positioner for positioning the blade, and a lighting system with some type of interconnection device. The support and testing apparatus has a frame to support the snow plow assembly. The frame includes a coupler for mechanically engaging the snow plow frame so that the plow assembly is supported on and retained by the frame. The apparatus also includes a plurality of wheels which are attached to the frame. At least one of these wheels is a caster which is pivotally mounted to the frame so that the wheel can pivot 360 degrees relative to the frame. The apparatus also includes an actuator system supported on the frame. The actuator is capable of actuating the hydraulic positioner on the plow assembly. The apparatus also includes an electrical lighting supply supported on the frame. The lighting supply includes a coupler for engaging the interconnection device of the lighting system of the plow assembly. The lighting supply is operable to selectively supply power to the lighting system for testing purposes. The apparatus also includes a control panel with a plurality of switches for operating the actuator system and the electrical lighting supply.

DETAILED DESCRIPTION OF THE PREFERRED EMBODIMENTS

Figure 1:
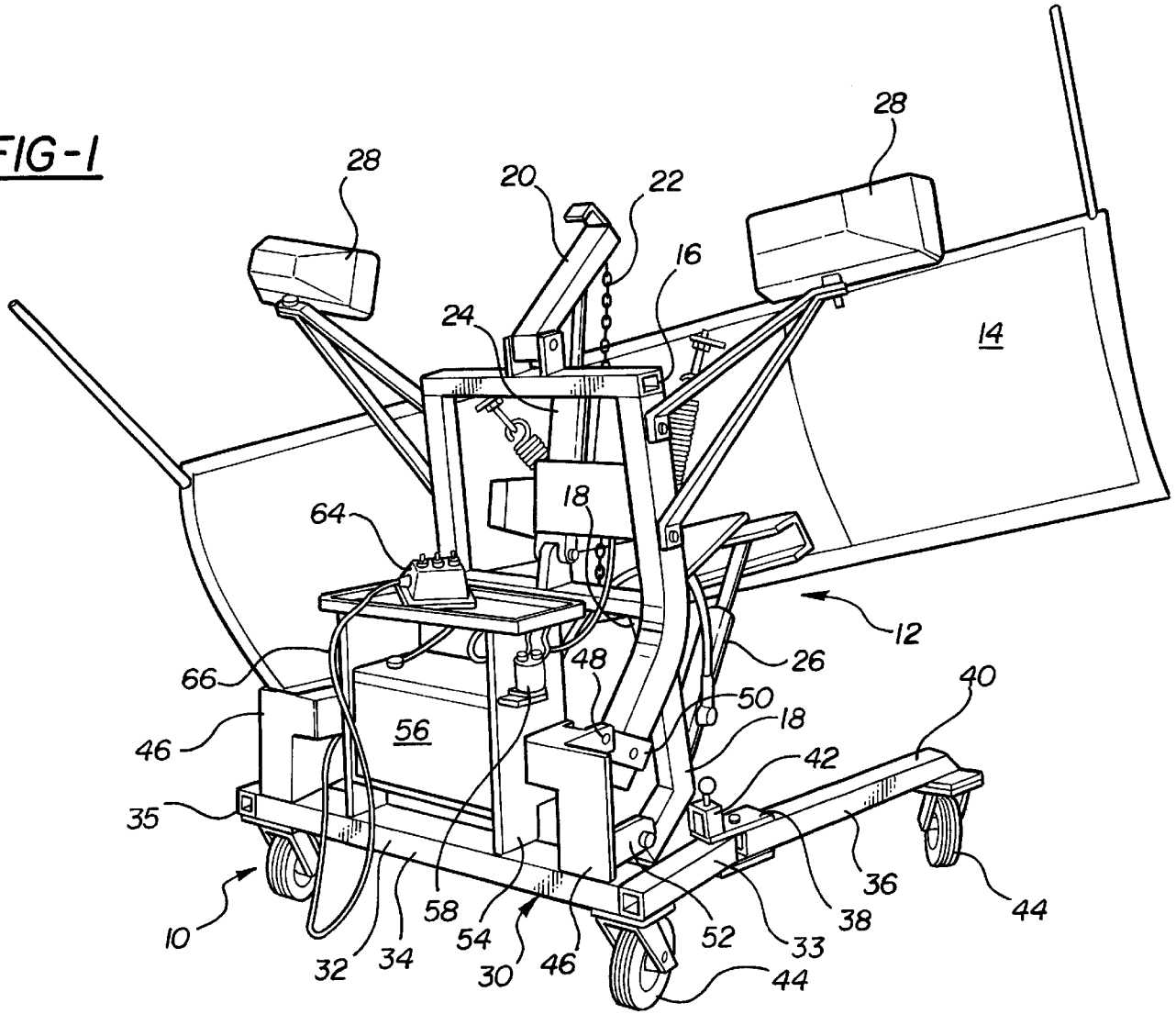
FIG. 1 is a rear perspective view of a support and testing apparatus according to the present invention with a snow plow assembly mounted thereto.

Referring to FIG. 1, a support and testing apparatus according to the present invention is generally shown at 10 with a representative snow plow assembly 12 supported thereon. As known to those of skill in the art, snow plow assemblies come in a variety of configurations. Therefore, the illustrated assembly 12 is meant to be representative of one type of assembly. The present invention may be configured for use with other types of plow assemblies as well.

The representative plow assembly 12 includes a snow plow blade 14 which is supported by a snow plow frame 16. The plow frame 16 is configured to attach to the front of a plow vehicle, such as a four wheel drive truck, by interconnecting with the frame of the vehicle. The portion of the plow frame 16 that directly attaches to the blade 14 is often called an A-frame. The A-frame 18 connects to the center of the blade 14 and is pivotally interconnected with the remainder of the plow frame 16 so that it can move upwardly and downwardly. A lift arm 20 extends forwardly from the top of the plow frame 16 and has a chain 22 interconnected with its forwardmost end. The chain extends downwardly and attaches to the A-frame 18 so that lifting of the lift arm 20 causes the A-frame 18, and hence the blade 14, to be lifted upwardly. A hydraulic positioner, which includes a hydraulic lift cylinder 24, is interconnected between the plow frame 16 and the lift arm 20 and is operable to move the lift arm 20 upwardly and downwardly.

The blade 14 is pivotally mounted to the A-frame 18 for pivoting side to side. A hydraulic pivot actuator 26 interconnects between the A-frame 18 and the blade 14 for pivoting the blade 14 side to side.

Most plow assemblies 12 include a hydraulic positioner which includes an electrically powered hydraulic pump (not shown) mounted to the plow frame 16 for supplying pressurized hydraulic fluid to the lift actuator 24 and pivot actuator 26. Alternatively, the electrically powered hydraulic pump may be mounted remotely, such as under the hood of the plow vehicle, rather than on the plow frame 16. The plow assembly 12 also includes lights 28 which may include driving lights and turn signal indicators. The lights 28 are part of a lighting system for the plow assembly 12 and therefore include the necessary wiring and connectors.

Figure 2:
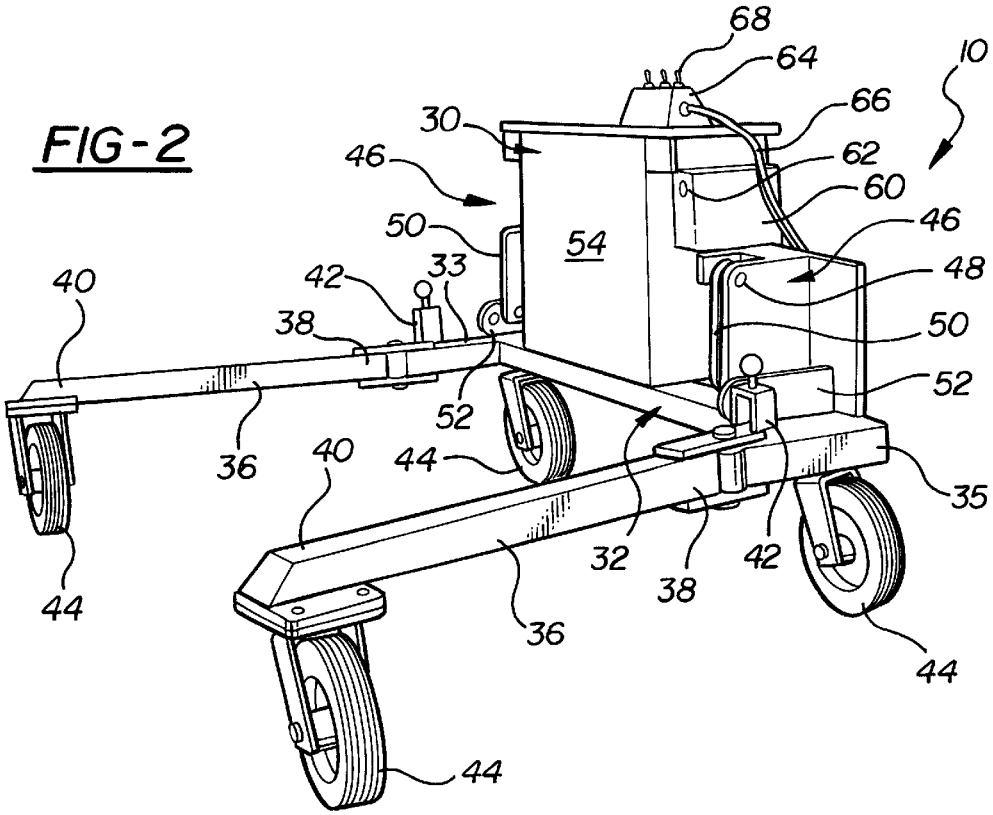
FIG. 2 is a side perspective view of a support and testing apparatus according to the present invention.
Figure 3:
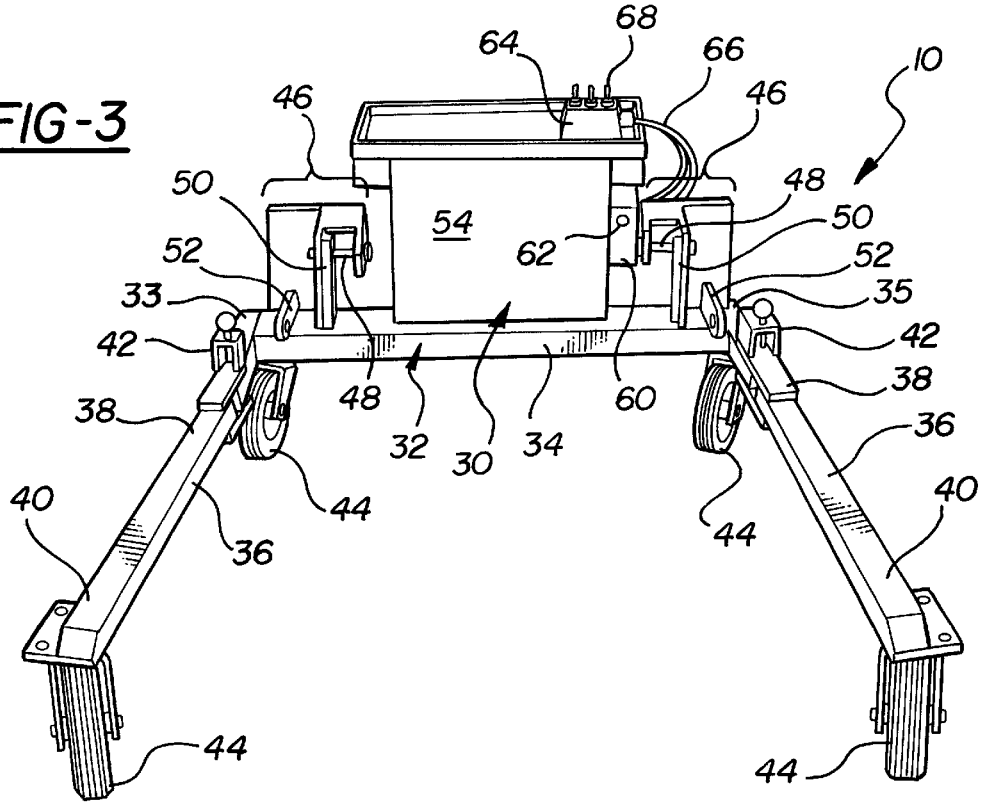
FIG. 3 is a front perspective view of the support and testing apparatus of FIG. 2.
Figure 4:
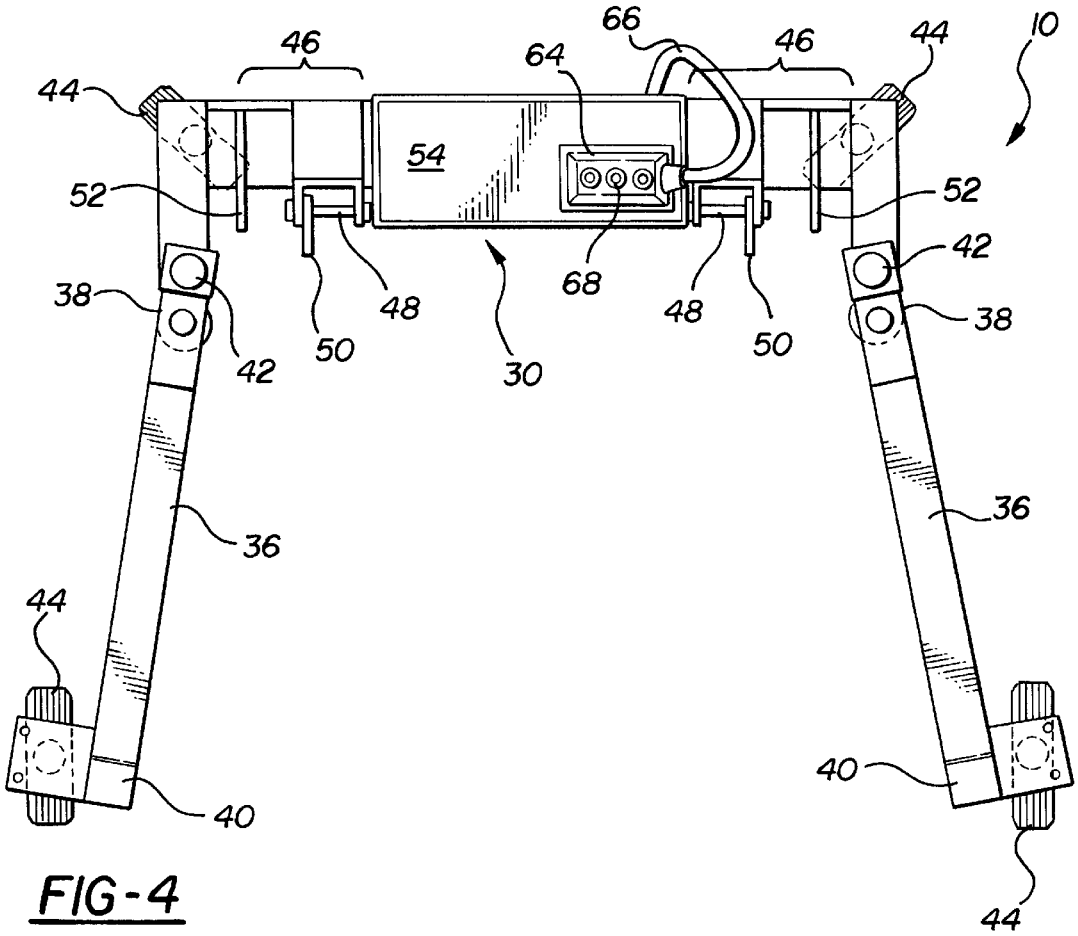
FIG. 4 is a top plan view of the support and testing apparatus of FIG. 2.
Figure 5:
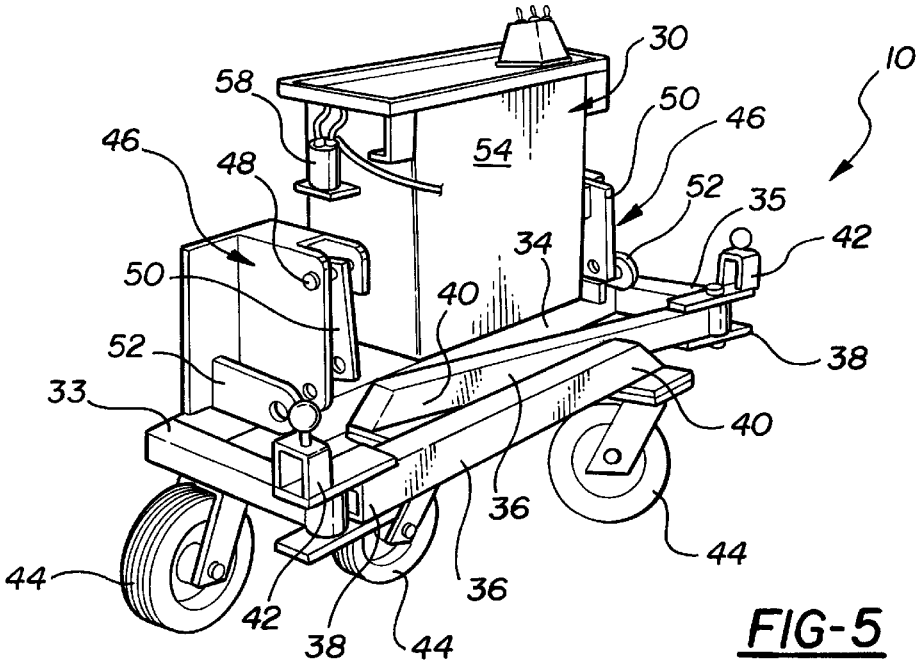
FIG. 5 is a perspective view of the support and testing apparatus of FIG. 2 with the support legs folded against the main portion of the frame.

Referring now to FIGS. 2–5, the support and testing apparatus 10 will be described in more detail. The apparatus 10 includes a frame 30 which is designed to support a snow plow assembly, such as the representative assembly 12 shown in FIG. 1. The frame 30 includes at least one coupler for mechanically engaging a snow plow frame so that a plow assembly is supported on and retained by the frame 30. In the illustrated embodiment, the frame 30 includes a main portion 32 which is in part defined by a horizontal cross member 34. The horizontal cross member 34 includes a first end 33 and a second end 35. A pair of support legs 36 are pivotally interconnected with the main portion 32 of the frame 30. Each of the support legs 36 has a pivot end 38 and an opposite support end 40. The pivot ends 38 are pivotally interconnected with the ends 33, 35 of the cross member 34 of the frame 30. Because the support legs 36 are pivotally interconnected to the main portion 32, the support legs 36 may be folded against the main portion 32 as shown in FIG. 5. In this storage position, the support ends 40 of the support legs 36 are close to the main portion 32 of the frame 30 making for a very compact package. When the support and testing apparatus 10 is to be used, the support legs are positioned as shown in FIGS. 2–4 with their support ends 40 extending outwardly from the main portion 32. In this position, the frame 30 has a broad support base and is therefore stable. Latches 42 are provided on the pivot ends 38 of the support legs 36 for latching the support legs into their support and/or storage positions. Obviously, the support legs 36 may also be positioned at other angles relative to the main portion 32 of the frame so as to provide the best stability for a given plow assembly. Some plow assemblies are larger and wider than others and therefore may require the support legs 36 to be splayed out further than with other assemblies.

A plurality of wheels 44 are attached to the frame 30. In the illustrated embodiment, four wheels 44 are provided with two wheels being positioned under the main portion 32 of the frame 30 and one wheel being attached to the support end 40 of each of the support legs 36. The two wheels 44 supporting the main portion 32 are preferably positioned under the ends 33, 35 of the cross member 34. Preferably, some or all of the wheels 44 are casters. Within the context of this disclosure, a caster is defined as a wheel support assembly in which a w heel can move in two separate degrees of freedom, the first being rotational motion about the axle of the wheel, and the second being pivotal motion relative to the frame 30 wherein the axle pivots 360 degrees in a plane so that the ends of the axle sweep out a circle. The use of casters allows for easier maneuverability of the apparatus 10.

As discussed earlier, the central portion 32 of the frame 30 includes a horizontal cross member 34. Adjacent each end 33, 35 of this horizontal cross member 34 are mounts which form the coupler portion of the frame 30 for interconnection with a snow plow frame. Obviously, the coupler provided will vary depending upon the type of snow plow assembly which is to be retained. Therefore, a variety of different types of mounts may be provided. In the illustrated embodiment, the coupler comprises two mounts which are generally indicated at 46. Each mount consists of a horizontal pin 48, a link 50, and a mounting tab 52. This configuration is well suited to interconnecting with certain types of snow plow frames which require this arrangement of mounts for interconnection therewith. In other words, each mount 46 mimics the mounting arrangement that would be provided on a vehicle configured to accept a particular type of snow plow assembly. Obviously, other types of snow plow assemblies will require different mounts, and different mounts may be provided on the central portion 32 of the frame 30. In fact, the mounts 46 may be made detachable from the horizontal cross member 34 so that different types of mounts 46 may be substituted as necessary.

Between the mounts 46 on the horizontal cross member 34 a housing 54 extends upwardly. As best shown in FIG. 1, this housing 54 encloses a large electrical battery 56. The battery 56 is used to provide power to the electric pump and lights of the plow assembly 12. In the illustrated embodiment, it is assumed that the plow assembly 12 being serviced includes an electric pump for providing pressurized hydraulic fluid to the hydraulic actuators 24 and 26, and in this case, the battery itself will be considered to be the actuator for the hydraulic system of the plow. As shown, the battery 56 communicates with the pump via a relay 58. Alternatively, the actuator system may further include a hydraulic pump or other source of pressurized hydraulic fluid to operate the hydraulic actuators on a plow assembly that lacks its own pump.

The support and testing apparatus 10 also preferably includes an electrical lighting supply which is designed to interconnect with the lighting system of a plow assembly and to selectively supply power to the lighting system. In the illustrated embodiment, the battery 56 also supplies power to the lighting system. As shown, an interconnection box 60 is mounted to the side of the housing 54 and includes a coupler for interconnecting with the wiring of a plow assembly. This coupler may be a plug 62 as shown on the box 60 in FIG. 3. Alternatively, various types of interconnection cables may run from the interconnection box 60 for connection to the wiring of a plow assembly. The lighting supply also includes the necessary wiring and controls to operate a lighting system on a plow assembly.

The support and testing apparatus 10 also preferably includes some type of control panel for controlling the actuator system, in this case the battery 56 and relay 58, and the electrical lighting supply, which includes the plug 62. Obviously, the plug 62 is wired so as to provide the necessary power and ground for operating the lighting system on the plow assembly. In the illustrated embodiment a control panel 64 is shown sitting on top of the housing 54 and interconnected with the remainder of the apparatus 10 by a tether 66. The control panel 64 has multiple switches 68 mounted thereon. These switches 68 control various functions of a plow assembly attached to the support and testing apparatus 10. For example, one switch may control up and down movement of the hydraulic lifting actuator 24 while another switch controls side to side pivotal movement of the hydraulic pivot actuator 26. Yet another switch can be dedicated to control of the lighting system. The control panel 64 shown is merely an example of one possible type of control panel. As known to those of skill in the art, many plow assemblies include specially designed controls for controlling movement of the plow. Preferably, the support and testing apparatus 10 includes appropriate controls for operating an attached plow assembly in a manner mimicking operation on a vehicle. Some arrangements of the present invention include two control panels, one of which controls the actuator system and one of which controls the electrical lighting supply. With this arrangement, the control for the actuator system may be identical to the controls typically used by a vehicle operator for the control of the plow. One of both of the control panels may be interchangeably interconnected with the remainder of the support and testing apparatus so that different control panels may be substituted as necessary for use with different snow plow assemblies.

In view of the teaching presented herein, other modifications and variations of the present invention will be readily apparent to those of skill in the art. For example, the battery can be replaced with a power supply capable of being interconnected to a power grid. Alternatively, the system can include an internal combustion engine for providing hydraulic and/or generated electrical power. The foregoing drawings, discussion, and description are illustrative of some embodiments of the present invention, but are not meant to be limitations on the practice thereof. It is the following claims, including all equivalents, which define the scope of the invention.

I claim:

1. A snow plow assembly support and testing apparatus for use with a snow plow assembly of the type having a snow plow frame configured for attachment to a vehicle, a blade, at least one hydraulic positioner for positioning the blade, and a lighting system having an interconnection device, said apparatus comprising a frame for supporting the snow plow assembly, said frame comprising a coupler for mechanically engaging the plow frame so that the plow assembly is supported on and retained by said frame; the frame not comprising part of an automobile;

a plurality of wheels attached to and supporting said frame, at least one of said wheels being a caster wheel which is pivotally mounted to said frame so that said wheel can pivot 360 degrees relative to said frame;

an actuator system supported on said frame, said actuator system operable to actuate the at least one hydraulic positioner;

electrical lighting supply supported on said frame, said supply including a coupler for engaging the interconnection device of the lighting system of the plow assembly, said lighting supply operable to selectably supply power to the lighting system; and a control panel having a plurality of switches for operating said actuator system and said electrical lighting supply.

2. The support and testing apparatus according to claim 1 wherein the hydraulic positioner of the plow system includes electrically powered pump in communication with a hydraulic cylinder, and said actuator system comprises an electrical power supply for operating the pump.

3. The support and testing apparatus according to claim 1, wherein said frame comprises a main portion and a support leg having a pivot end pivotally interconnected with said main portion and a support end, one of said plurality of wheels being attached to said support end of said support leg.

4. The support and testing apparatus according to claim 3, wherein said frame further comprises a second support leg having a pivot end pivotally interconnected with said main portion and a support end, one of said plurality of wheels being attached to said support end of said second support leg.

5. The support and testing apparatus according to claim 4, wherein said support legs have a support position wherein said support legs extend outwardly from said main portion and a storage position wherein said support legs folded against said main portion.

6. The support and testing apparatus according to claim 5, wherein said frame further comprises a latch for securing one of said support legs in the support position.

7. The support and testing apparatus according to claim 1, wherein the snow plow frame includes a plurality of mounting portions and said coupler comprises a plurality of mounts for engaging the mounting portions.

8. The support and testing apparatus according to claim 1, wherein said actuator system comprises a source of pressurized hydraulic fluid.

9. The support and testing apparatus according to claim 8, wherein said source of pressurized hydraulic fluid comprises a hydraulic pump.

10. The support and testing apparatus according to claim 1, further comprising a flexible tether interconnecting said control panel with said frame.

11. The support and testing apparatus according to claim 1, wherein said control panel comprises a first control panel controlling said actuator system and a second control panel for controlling said electrical lighting supply.

* * * * *